US007478898B2

(12) United States Patent
Yamada et al.

(10) Patent No.: US 7,478,898 B2
(45) Date of Patent: Jan. 20, 2009

(54) RECORDING HEAD FOR INKJET RECORDING DEVICE

(75) Inventors: Takahiro Yamada, Hitachinaka (JP); Shinya Kobayashi, Hitachinaka (JP); Satoru Tobita, Hitachinaka (JP); Katsuya Kawai, Hitachinaka (JP); Hitoshi Kida, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 390 days.

(21) Appl. No.: 11/303,912

(22) Filed: Dec. 19, 2005

(65) Prior Publication Data

US 2006/0132548 A1 Jun. 22, 2006

(30) Foreign Application Priority Data

Dec. 20, 2004 (JP) ..... P2004-367238

(51) Int. Cl.
*B41J 2/045* (2006.01)
*B41J 29/38* (2006.01)

(52) U.S. Cl. ..... 347/68; 347/10

(58) Field of Classification Search ..... 347/70, 347/72, 45

See application file for complete search history.

(56) References Cited

U.S. PATENT DOCUMENTS 5,912,526 A * 6/1999 Okawa et al. ..... 310/328
6,168,255 B1 * 1/2001 Nagashima ..... 347/20
6,520,617 B2 * 2/2003 Blair ..... 347/20
6,971,737 B2 * 12/2005 Sugahara ..... 347/68

FOREIGN PATENT DOCUMENTS

| | | |
|---|---|---|
| JP | 6-270403 | 9/1994 |
| JP | 9-99554 | 4/1997 |
| JP | 2002-361868 | 12/2002 |

* cited by examiner

*Primary Examiner*—Luu Matthew
*Assistant Examiner*—Lisa M Solomon
(74) *Attorney, Agent, or Firm*—Whitham Curtis Christofferson & Cook, PC

(57) ABSTRACT

An ink jet recording head unit includes a plurality of nozzle elements, a plurality of piezoelectric elements and a driving unit. The plurality of piezoelectric elements is provided in one-to-one correspondence with the plurality of nozzle elements. Each piezoelectric element has a positive pole and a negative pole. Each piezoelectric element expands and contracts when a voltage potential difference between the positive pole and the negative pole is varied. The plurality of nozzle elements includes a first nozzle element and a second nozzle element adjacent to the first nozzle element. A first piezoelectric element and a second piezoelectric element correspond to the first nozzle element and the second nozzle element respectively. The driving unit controls the first piezoelectric element and the second piezoelectric element to expand and contract in a complementary manner.

20 Claims, 7 Drawing Sheets

RECORDING HEAD FOR INKJET RECORDING DEVICE

BACKGROUND OF THE INVENTION

1. Field of the Invention

The present invention relates to a recording head capable of recording high quality images rapidly and reliably, and to an inkjet recording device equipped with the recording head.

2. Description of Related Art

In order to record high-quality images rapidly and reliably using an on-demand inkjet recording device having a plurality of densely integrated nozzles, it is particularly necessary to increase the ink droplet ejection rate and to achieve stable ink ejection at a high frequency.

One structure of nozzles configured of push-type piezoelectric elements is disclosed in Japanese unexamined patent application publication No. HEI-6-270403. In this push-type piezoelectric element system, vertical vibrations of a pole-shaped piezoelectric element push a diaphragm that constitutes one surface of an ink pressure chamber, decreasing the volume in the pressure chamber and causing an ink droplet to be ejected from the nozzle hole. Pole-shaped piezoelectric elements of a number equal to the number of nozzle holes are arranged in a row. One end of the pole-shaped piezoelectric element opposite another side that contacts the diaphragm is fixed to a support base. The support base is affixed to a head housing.

However, when piezoelectric elements are driven in a recording head having this construction, vertical vibrations from the piezoelectric element are transferred not only to the diaphragm, but also to the support base, the head housing, and the like, making ink droplet ejection unstable. Vibrations from the piezoelectric element also affect nozzles adjacent to the nozzle corresponding to the piezoelectric element, generating what is called cross talk, which produces fluctuations in the ink droplet ejection characteristics.

In order to avoid this problem, Japanese unexamined patent application publication No. 2002-361868 discloses an inkjet recording device in which the piezoelectric element support base is configured of a stiff member capable of absorbing vibrations from the piezoelectric element.

Another inkjet recording device disclosed in Japanese unexamined patent application publication No. HEI-9-99554 supplies a piezoelectric element with a voltage considering the effects of vibrations on neighboring piezoelectric elements to alleviate mutual interference between nozzle units.

However, when using one of the methods described in Japanese unexamined patent application publications Nos. 2002-361868 and HEI-9-99554, abnormal vibrations were generated in a specific frequency range in parts or all of the print head when ejecting ink droplets. These abnormal vibrations generate ink mist or cause the ink ejection direction to deviate from the desired direction. These abnormal vibrations also cause ink to protrude from the nozzle hole and wet the region around the hole. This can result in ejection failures or, when ink droplets are ejected, irregular ejection characteristics due to cross talk.

This is particularly problematic when lengthening the head to integrate a plurality of nozzles therein, as in a push-type on-demand recording head, or when lowering the resonance frequency of such components as the piezoelectric element support base and increasing the excitation force in order to eject ink with a high viscosity.

Further, conventional recording head driving devices are provided with control elements, such as switching elements, and a flexible cable connecting each control element to a piezoelectric element, in order to selectively apply a drive pulse to piezoelectric elements corresponding to each nozzle. Accordingly, a recording head having a plurality of densely integrated nozzles requires a larger number of control elements and wires in the flexible cable, thereby increasing costs and leading to problems in mounting.

SUMMARY OF THE INVENTION

In view of the above-described drawbacks, it is an objective of the present invention to provide a recording head and an inkjet recording device equipped with the recording head that are capable of consistently ejecting ink droplets with stability, without producing abnormal vibrations in components of the recording head.

It is another object of the present invention to provide a recording head and an inkjet recording device that are inexpensive to produce and easy to mount, by reducing the number of switching elements required for selectively driving the piezoelectric elements.

In order to attain the above and other objects, the present invention provides an ink jet recording head unit including a plurality of nozzle elements, a plurality of piezoelectric elements and a driving unit.

The plurality of nozzle elements ejects ink droplets. Each nozzle element has an ink pressure chamber filling ink therein, an orifice leaded to the ink pressure chamber, and a diaphragm formed as a part of the ink pressure chamber and having a first surface opposed to the ink pressure chamber, and a second surface opposite to the first surface.

The plurality of piezoelectric elements is provided in one-to-one correspondence with the plurality of nozzle elements. Each piezoelectric element is fixed to the second surface of each diaphragm and has a positive pole and a negative pole. Each piezoelectric element expands and contracts to vary volume of the ink pressure chamber when a voltage potential difference between the positive pole and the negative pole is varied. Each nozzle element ejects an ink droplet from the corresponding orifice when the volume of the corresponding ink pressure chamber decreases.

The driving unit controls expansion and contraction of each piezoelectric element. The plurality of nozzle elements includes a first nozzle element and a second nozzle element adjacent to the first nozzle element. A first piezoelectric element and a second piezoelectric element correspond to the first nozzle element and the second nozzle element respectively. The driving unit controls the first piezoelectric element and the second piezoelectric element to expand and contract in a complementary manner.

Another aspect of this invention provides an ink jet recording device including an ink jet recording head having a plurality of nozzle elements and a plurality of piezoelectric elements, and a driving unit.

The plurality of nozzle elements ejects ink droplets. Each nozzle element has an ink pressure chamber filling ink therein, an orifice leaded to the ink pressure chamber, and a diaphragm formed as a part of the ink pressure chamber and having a first surface opposed to the ink pressure chamber, and a second surface opposite to the first surface.

The plurality of piezoelectric elements is provided in one-to-one correspondence with the plurality of nozzle elements. Each piezoelectric element is fixed to the second surface of each diaphragm and having a positive pole and a negative pole. Each piezoelectric element expands and contracts to vary volume of the ink pressure chamber when a voltage potential difference between the positive pole and the negative pole is varied. Each nozzle element ejects an ink droplet from the corresponding orifice when the volume of the corresponding ink pressure chamber decreases.

The driving unit controls expansion and contraction of each piezoelectric element. The plurality of nozzle elements includes a first nozzle element and a second nozzle element adjacent to the first nozzle element. A first piezoelectric element and a second piezoelectric element correspond to the first nozzle element and the second nozzle element respectively. The driving unit controls the first piezoelectric element and the second piezoelectric element to expand and contract in a complementary manner.

Another aspect of this invention provides an ink jet recording device including an ink jet recording head having a plurality of nozzle elements and a plurality of piezoelectric elements, and a driving unit having a drive signal generating unit, a switching element and a switching element driving unit.

The plurality of nozzle elements ejects ink droplets. Each nozzle element has an ink pressure chamber filling ink therein, an orifice leaded to the ink pressure chamber, and a diaphragm formed as a part of the ink pressure chamber and having a first surface opposed to the ink pressure chamber, and a second surface opposite to the first surface.

The plurality of piezoelectric elements is provided in one-to-one correspondence with the plurality of nozzle elements. Each piezoelectric element is fixed to the second surface of each diaphragm and having a positive pole, a negative pole, a common electrode to which a drive signal is applied and an individual electrode. Each piezoelectric element expands and contracts to vary volume of the ink pressure chamber when a voltage potential difference between the positive pole and the negative pole is varied. Each nozzle element ejects an ink droplet from the corresponding orifice when the volume of the corresponding ink pressure chamber decreases.

The driving unit controls expansion and contraction of each piezoelectric element. The drive signal generating unit generates the drive signals. The switching element is capable of performing on/off switching actions. The switching element has a first terminal to which a predetermined voltage is applied and a second terminal connected to the individual electrodes of both of the first piezoelectric element and the second piezoelectric element commonly so that each piezoelectric element expands and contracts when the switching element is closed. The switching element driving unit controls the on/off actions of the switching element.

The plurality of nozzle elements includes a first nozzle element and a second nozzle element adjacent to the first nozzle element. A first piezoelectric element and a second piezoelectric element correspond to the first nozzle element and the second nozzle element respectively. The positive pole of the first piezoelectric element is connected to the common electrode of the first piezoelectric element and the negative pole of the first piezoelectric element is connected to the individual electrode of the first piezoelectric element, when the positive pole of the second piezoelectric element is connected to the individual electrode of the second piezoelectric element and the negative pole of the second piezoelectric element is connected to the common electrode of the second piezoelectric element.

BRIEF DESCRIPTION OF THE DRAWINGS

The above and other objects, features and advantages of the invention will become more apparent from reading the following description of the preferred embodiments taken in connection with the accompanying drawings in which:

FIG. 3(*b*) is an explanatory diagram illustrating operations of the recording head according to the first embodiment;

FIG. 3(*c*) is an explanatory diagram illustrating operations of the recording head according to the first embodiment;

DETAILED DESCRIPTION OF THE PREFERRED EMBODIMENTS

Figure 1:
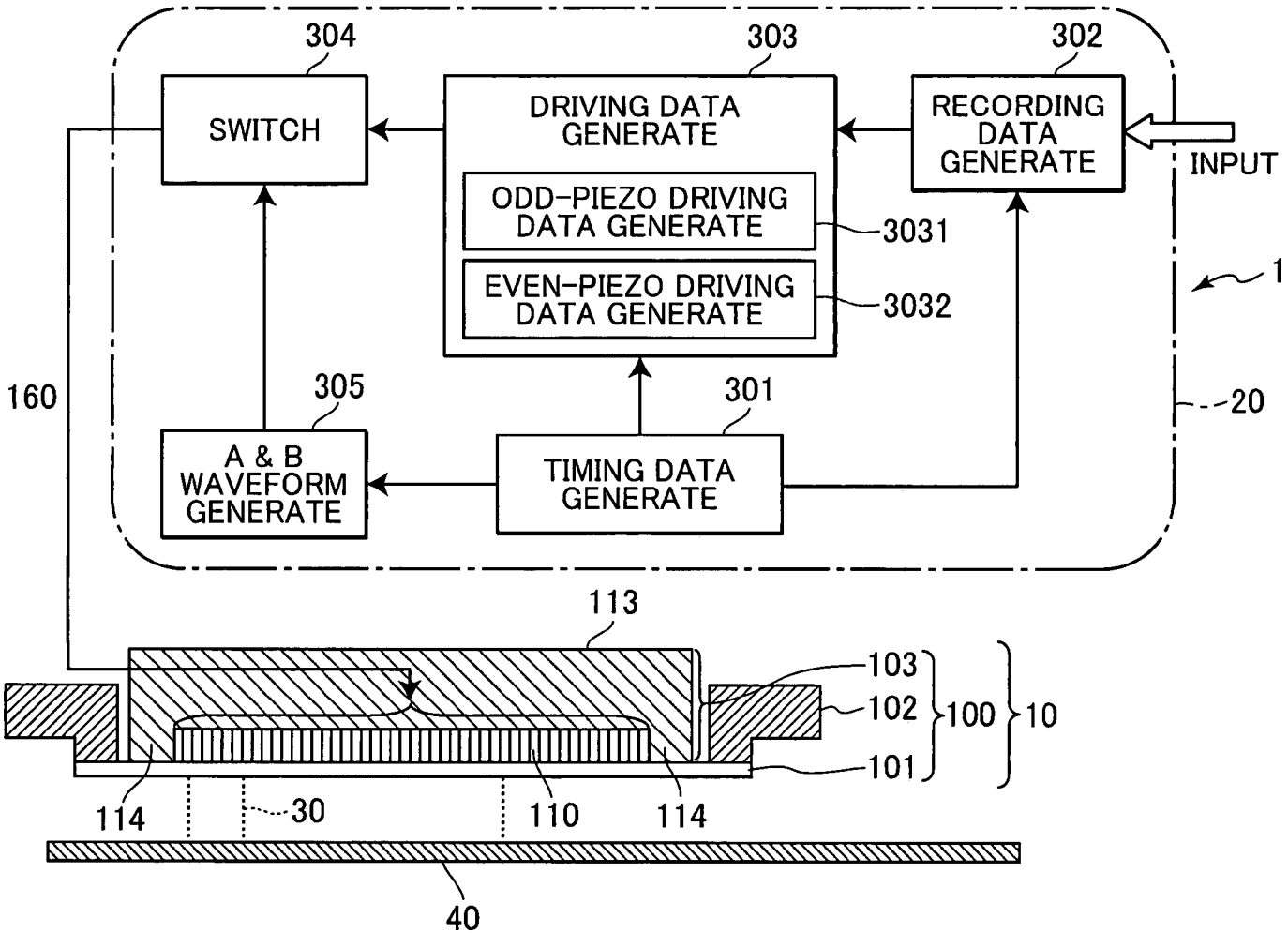
FIG. 1 is a schematic diagram and a block diagram of an inkjet recording device according to a first embodiment of the present invention.

An inkjet recording device according to a first embodiment of the present invention will be described with reference to FIGS. 1 through 4. FIG. 1 shows the structure of an inkjet recording device 1. The inkjet recording device 1 includes a recording head 10 according to the preferred embodiment, and a recording head driving device 20.

As shown in FIG. 1, the recording head 10 includes an ink channel unit 101, a head housing 102 for retaining the ink channel unit 101, and a piezoelectric element unit 103. The piezoelectric element unit 103 further includes pole-shaped piezoelectric elements 110 and a piezoelectric element support base 113 having a squared U-shape. One end of each of the piezoelectric elements 110 is fixed to the piezoelectric element support base 113, and the other end to the ink channel unit 101. The ink channel unit 101 accommodates ink that is ejected as an ink droplet 30 onto a recording paper 40 when pressed by the piezoelectric element 110.

Figure 2:
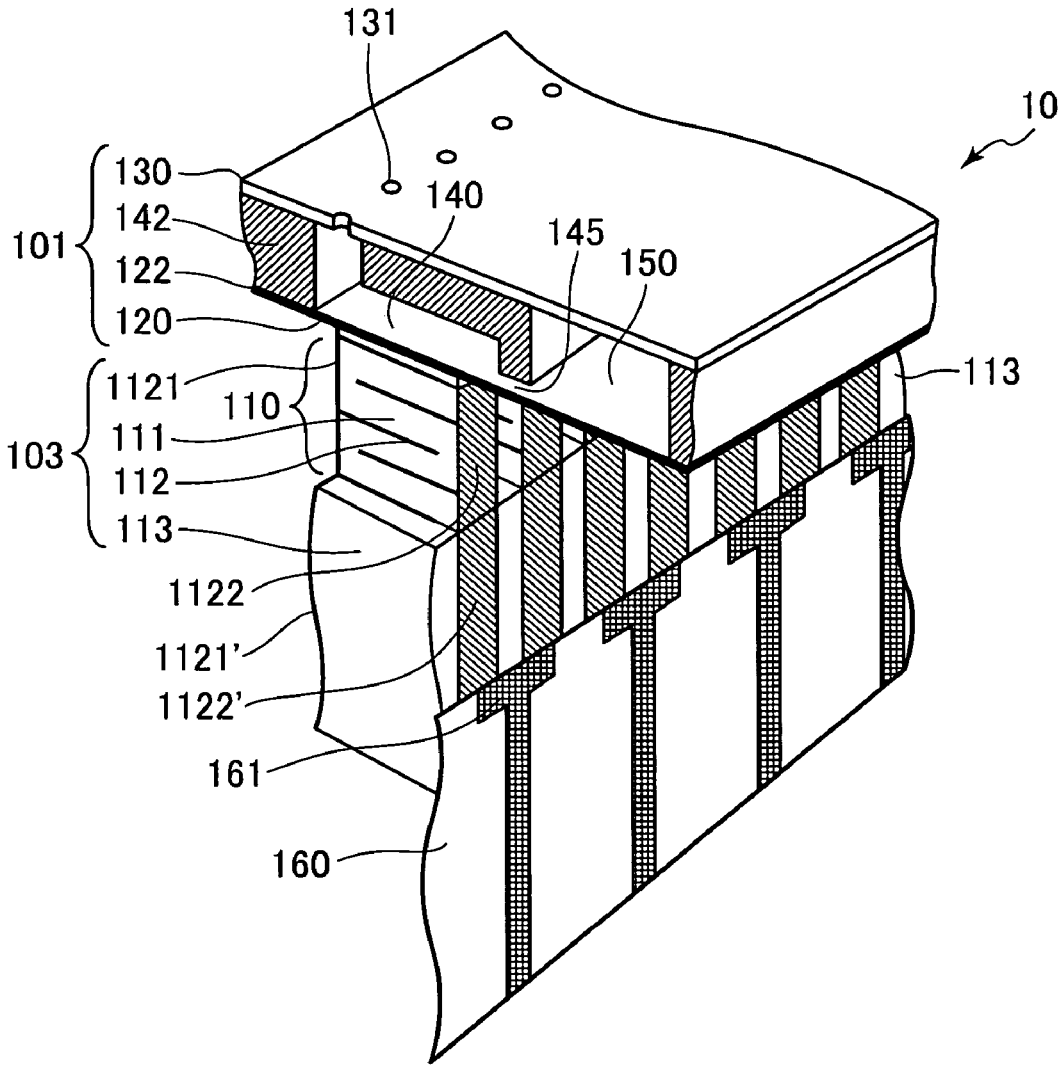
FIG. 2 is a perspective view of a recording head according to the first embodiment.

Next, the recording head 10 will be described in greater detail with reference to FIG. 2. FIG. 2 shows the overall structure of the recording head 10. The recording head 10 in FIG. 2 is oriented opposite the recording head 10 shown in FIG. 1 in the vertical direction. The ink channel unit 101 includes an orifice plate 130, an ink channel forming plate 142, and a diaphragm forming plate 122. The ink channel forming plate 142 is interposed between the orifice plate 130 and the diaphragm forming plate 122, and is bonded to both of the orifice plate 130 and the diaphragm forming plate 122 by an adhesive, anodic bonding, or the like. Nozzle holes 131 are formed through the orifice plate 130 so as to form a row in which the nozzle holes 131 are separated at a prescribed pitch. The surface of the diaphragm forming plate 122 opposed to the orifice plate 130 is configured of a diaphragm 120.

Interposing the ink channel forming plate 142 between the orifice plate 130 and diaphragm 120 forms ink pressure chambers 140 in fluid communication with an end of the nozzle holes 131, ink channel inlets 145 for directing ink to the ink pressure chambers 140, and a common ink chamber 150 for supplying ink to the ink channel inlets 145. The surface of the diaphragm forming plate 122 on which the diaphragm 120 is formed configures one wall surface of the ink pressure chambers 140, while the other surface is bonded by adhesive to an end of the piezoelectric elements 110 provided in the piezoelectric element unit 103.

The piezoelectric elements 110 are fixed to the piezoelectric element support base 113 in a configuration similar to the teeth of a comb so as to correspond to the nozzle holes 131. Each of the piezoelectric elements 110 is configured of a plurality of layered piezoelectric elements 111 and a plurality of layered electrodes 112. The piezoelectric elements 111 and electrodes 112 are stacked alternately in the vertical direction of the drawing. A common electrode 1121 and an individual electrode 1122 are provided on opposite side surfaces of the piezoelectric elements 110. The electrodes 112 are alternately connected to the common electrode 1121 and the individual electrode 1122.

Further, a common electrode 1121' and a plurality of individual electrodes 1122' are formed on the piezoelectric element support base 113 and are connected to the common electrode 1121 and individual electrode 1122, respectively. The individual electrodes 1122' are also connected by pairs to flexible cable terminals 161 of a flexible cable 160. The flexible cable 160 connects the piezoelectric elements 110 to a switching circuit 304 (see FIGS. 1 and 3(*a*)) described later for driving the piezoelectric elements 110.

As shown in FIG. 1, two columnar support base fixing units 114 are provided on either end of the piezoelectric element support base 113 with respect to the row of piezoelectric elements 110. The bottom surface of the support base fixing units 114 is fixed by adhesive or the like to the ink channel unit 101. The ink channel unit 101 in turn is adhesively fixed to the head housing 102 on endpoints near the areas bonded to the support base fixing units 114. Accordingly, the support base fixing units 114 are fixed relative to the head housing 102.

With this construction, the ink pressure chambers 140 in fluid communication with the nozzle holes 131 and the piezoelectric elements 110 form n nozzle elements #1, #2, . . . , n in the recording head 10.

In the preferred embodiment, adjacent piezoelectric elements 110 are polarized with reverse polarity, and the amount of polarization is set approximately equal.

Figure 3A:
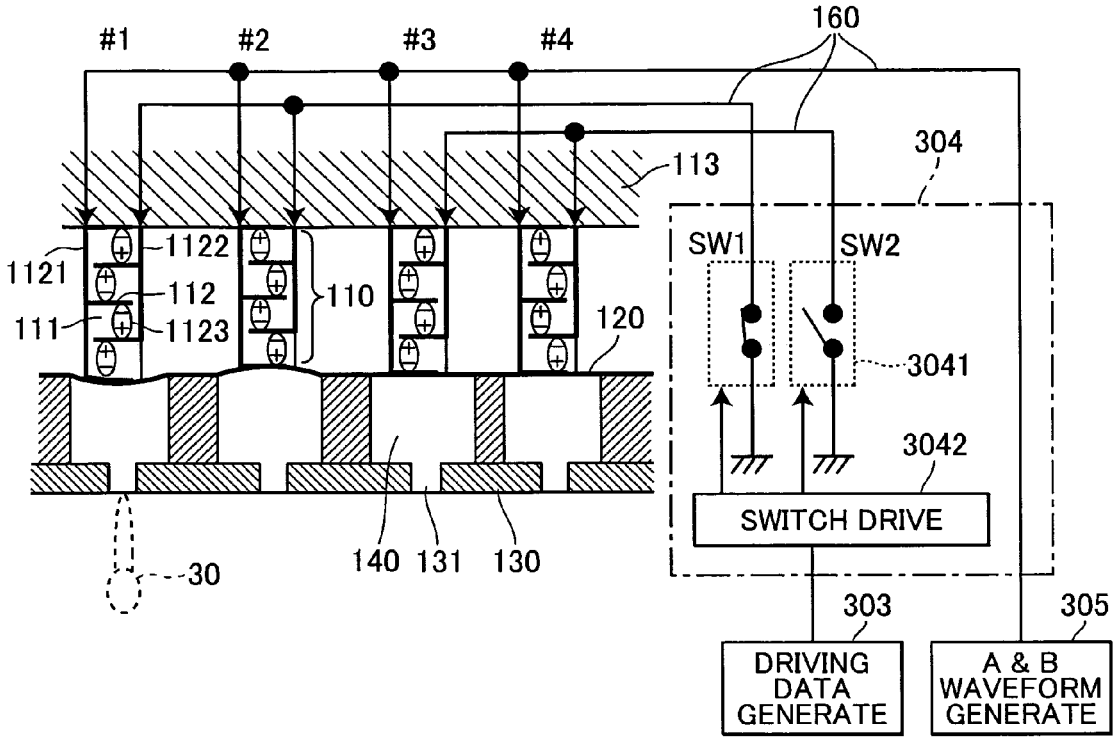
FIG. 3(*a*) is an explanatory diagram illustrating operations of the recording head according to the first embodiment.
Figure 3B:
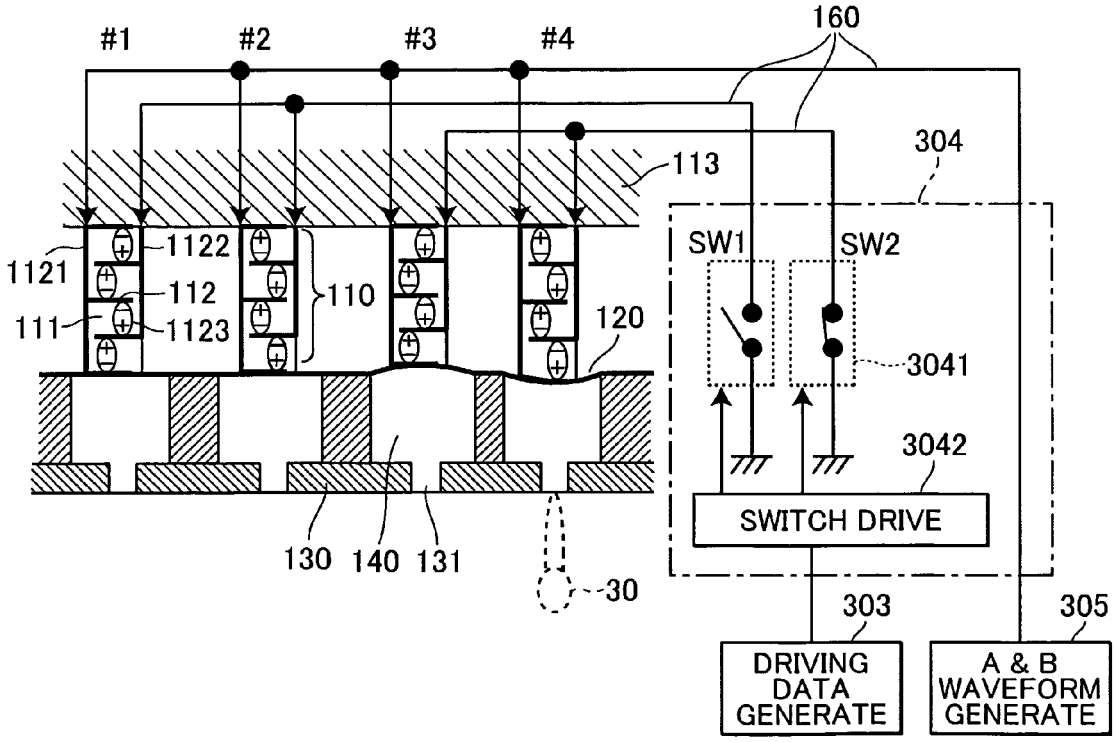
Figure 3C:
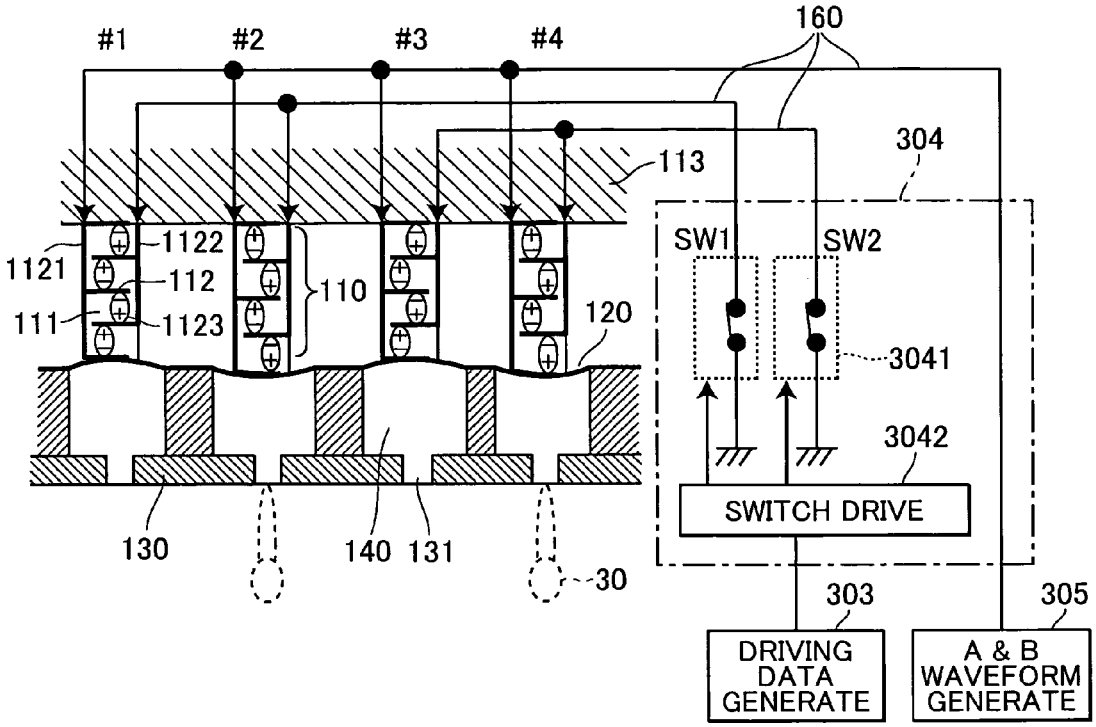

Therefore, in the case of a first nozzle element #1 and a second nozzle element #2 (see FIG. 3(*a*)), the piezoelectric element 110 retains the polarization shown in FIG. 3(*a*) that is substantially equivalent to, but directionally opposite of the polarization retained in the piezoelectric element 110 of second nozzle element #2. Hence, when a similar voltage is applied to both nozzle elements #1 and #2, the piezoelectric elements 110 in nozzle elements #1 and #2 are displaced approximately the same amount, but in opposing directions from each other. The volume of the ink pressure chambers 140 changes due to the expansion and contraction of the piezoelectric elements 110.

Next, the recording head driving device 20 will be described with reference to FIGS. 1 and 3(*a*). As shown in FIG. 1, the recording head driving device 20 includes a recording data signal generating circuit 302, a piezoelectric element drive data signal generating circuit 303, the piezoelectric element drive switching circuit 304, a timing signal generating circuit 301, and a A&B phase piezoelectric element driving pulse waveform generating circuit 305.

The recording data signal generating circuit 302 generates a recording data signal based on input data for a recording signal received from a host device (such as a personal computer, not shown). The piezoelectric element drive data signal generating circuit 303 further includes an odd-numbered piezoelectric element drive data signal circuit 3031 for driving piezoelectric elements in odd-numbered nozzles, and an even-numbered piezoelectric element drive data signal circuit 3032 for driving piezoelectric elements in even-numbered nozzles. The piezoelectric element drive data signal generating circuit 303 generates each of the piezoelectric element drive data signals based on the recording data signal generated by the recording data signal generating circuit 302 and a timing signal generated by the timing signal generating circuit 301.

The piezoelectric element drive switching circuit 304 includes a switching element drive circuit 3042, and a plurality of switching elements 3041 (SW1, SW2, . . . ; see FIG. 3(*a*)). The switching element drive circuit 3042 actuates the switching elements 3041 based on the piezoelectric element drive data signal generated by the piezoelectric element drive data signal generating circuit 303. One end of each switching elements 3041 is connected to two adjacent piezoelectric elements 110, while the other end is grounded.

Specifically, as shown in FIG. 3(*a*), a switching element SW1 is connected commonly to the individual electrode 1122 of the piezoelectric elements 110 in both nozzle elements #1 and #2. A switching element SW2 is connected commonly to the individual electrode 1122 of the piezoelectric elements 110 in both a third nozzle element #3 and a fourth nozzle element #4. In the same way, other switching elements are commonly connected to the individual electrode 1122 of two piezoelectric elements 110 belonging to a set of two adjacent nozzle elements.

Figure 4:
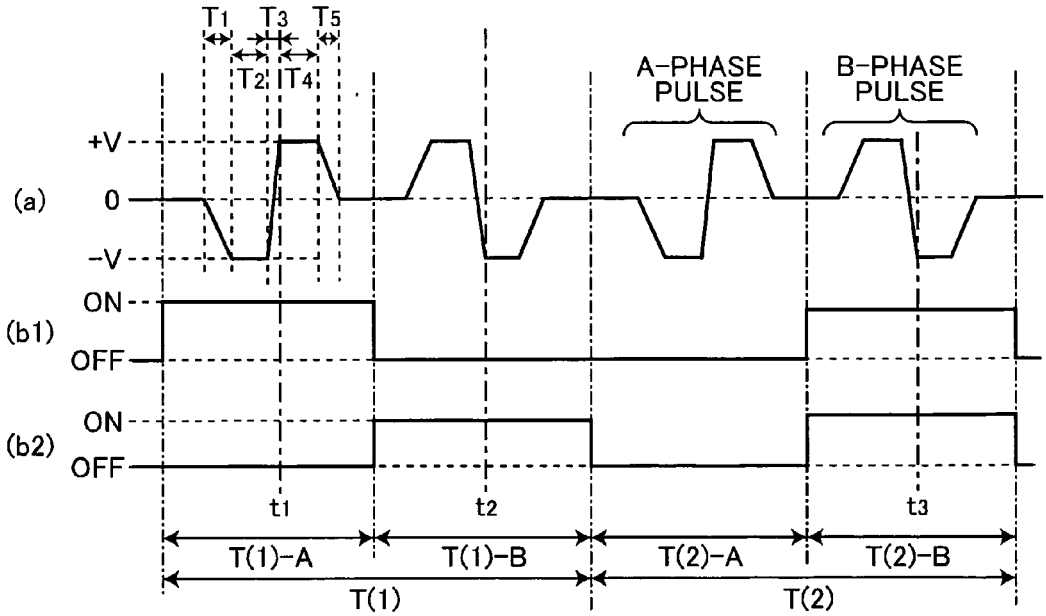
FIG. 4 is a graph of signal waveforms for various components in the recording head, illustrating operations of the recording head according to the first embodiment.

The A&B phase piezoelectric element driving pulse waveform generating circuit 305 generates a A-phase drive pulse and a B-phase drive pulse (see (*a*) in FIG. 4) for driving the piezoelectric elements 110. As shown in FIG. 3(*a*), the A&B phase piezoelectric element driving pulse waveform generating circuit 305 is commonly connected to common electrodes 1121 of the piezoelectric elements 110 via the piezoelectric element drive switching circuit 304 for all nozzle elements #1, #2, #3, . . . , #n. Hence, when the switching element SW1 is turned on, for example, a A-phase drive pulse or a B-phase drive pulse is applied simultaneously to piezoelectric elements 110 in the two adjacent nozzle elements #1 and #2.

Next, an ink ejection operation performed with the inkjet recording device 1 of the preferred embodiment will be described with reference to FIGS. 3(*a*), 3(*b*), 3(*c*), and 4. FIGS. 3(*a*)-3(*c*) are explanatory diagrams illustrating the operation of the recording head 10 according to the preferred embodiment. FIG. 4 is a timing chart of the signal waveforms for each element during an operation of the recording head 10, where (a) indicates an output waveform of the A&B phase piezoelectric element driving pulse waveform generating circuit 305, (b1) indicates a drive pulse waveform supplied to the switching element SW1, and (b2) indicates a drive pulse waveform supplied to the switching element SW2.

As shown in (*a*) of FIG. 4, the voltage of the A-phase drive pulse changes from 0 to −V during an interval T1 and remains at −V for a prescribed time T2. Subsequently, the voltage of the A-phase drive pulse rises from −V to +V during an interval T3 and remains at +V for a prescribed time T4, after which the voltage returns to 0 during an interval T5. The B-phase drive pulse acts opposite the A-phase drive pulse, rising from 0 to +V during the initial interval T1 and remaining at +V for the prescribed time T2. Subsequently, the voltage changes from +V to −V during the interval T3 and remains at −V for the prescribed time T4 before returning to 0 during the interval T5.

The switching element SW1 turns on when the drive pulse for the switching element SW1 (b1) is high, and turns off when the pulse is low. The switching element SW2 turns on when the drive pulse for the switching element SW2 (b2) is high, and turns off when the pulse is low As shown in FIG. 4, since the drive pulse for the switching element SW1 (b1) is high during a period T(1)-A, the switching element SW1 is on during this period. Further, since the level of the drive pulse for the switching element SW2 (b2) is low during this period, the switching element SW2 is off. In other words, as shown in FIG. 3(*a*), the contact point for the switching element SW1 is closed while the contact point for the switching element SW2 is open. Accordingly, the individual electrodes 1122 of nozzle elements #1 and #2 are both grounded via the switching element SW1, while the individual electrodes 1122 for nozzle elements #3 and #4 are in a floating state.

Since the A&B phase piezoelectric element driving pulse waveform generating circuit 305 is commonly connected to the common electrode 1121 of each piezoelectric element 110, a potential difference is generated between the common electrode 1121 and individual electrode 1122 of the nozzle elements #1 and #2 during the period T(1)-A. This potential difference corresponds to the voltage variation in the A-phase drive pulse shown in (*a*) of FIG. 4.

Hence, throughout the period T(1)-A, the piezoelectric element 110 of nozzle element #1 gradually contracts during the interval T1, maintains its contracted state during the interval T2, rapidly expands during the interval T3, maintains this expanded state in the interval T4, and gradually returns to its original state during the interval T5. In this way, the expansion and contraction of the piezoelectric element 110 changes the volume in the ink pressure chamber 140.

FIG. 3(*a*) shows nozzle element #1 in the state at time $t_1$ in FIG. 4, that is, when the piezoelectric element 110 has rapidly expanded. The expansion of the piezoelectric element 110 constricts the volume in the ink pressure chamber 140 so that the ink droplet 30 is ejected through the nozzle hole 131 of nozzle element #1. Since the polarization of the piezoelectric element 110 in the neighboring nozzle element #2 is set to about the same magnitude but has an opposite direction as that in nozzle element #1, expansion and contraction of the piezoelectric element 110 and ink pressure chamber 140 in nozzle element #2 is completely opposite that in nozzle element #1. Consequently, the volume of the ink pressure chamber 140 increases during the interval T3, and ink is supplied from the common ink chamber 150 to the ink pressure chamber 140 via the ink channel inlets 145.

Since the polarization directions of the piezoelectric elements 110 in nozzle elements #1 and #2 are opposite one another, an ink droplet is ejected through the nozzle hole 131 of nozzle element #1 and not through the nozzle hole 131 of nozzle element #2 when the A-phase drive pulse shown in (*a*) of FIG. 4 is applied.

Since switching element SW2 is off for the piezoelectric elements 110 in nozzle elements #3 and #4, a potential differential between the common electrode 1121 and individual electrode 1122 of the piezoelectric elements 110 does not change, even when the drive pulse voltage shown in (*a*) of FIG. 4 is applied to the individual electrodes 1122 in these nozzle elements. Hence, the piezoelectric elements 110 in nozzle elements #3 and #4 do not expand and contract, but remain still.

Further, when ink is supplied from the common ink chamber 150 to the ink pressure chamber 140, a force to draw ink in from the nozzle hole 131 also works. Hence, the meniscus formed in the nozzle hole 131 tends to be drawn toward the ink pressure chamber 140 and, in some cases, air bubbles can be sucked through the nozzle hole 131 into the ink pressure chamber 140. In order to prevent this problem, the size of the ink channel inlet 145 (see FIG. 2) should be fairly large, and the impedance of the ink channel inlet 145 should be set smaller than that of the nozzle hole 131.

Next, since the drive pulse for switching element SW1 (b1) is low during the following interval T(1)-B, the switching element SW1 is switched off. Further, since the drive pulse for the switching element SW2 (b2) is high, the switching element SW2 is switched on. Accordingly, the contact point for switching element SW1 is open, while the contact point for switching element SW2 is closed, as shown in FIG. 3(*b*). At this time, the individual electrode 1122 of the piezoelectric elements 110 in nozzle elements #3 and #4 are both grounded via switching element SW2.

Since the A&B phase piezoelectric element driving pulse waveform generating circuit 305 is connected to the common electrode 1121 of each piezoelectric element 110, a potential differential is generated between the common electrode 1121 and individual electrode 1122 of nozzle elements #3 and #4. This potential difference corresponds to voltage changes in the B-phase drive pulse shown in (*a*) of FIG. 4.

Therefore, the piezoelectric element 110 of nozzle element #4 expands at the time $t_2$, constricting the volume in the ink pressure chamber 140 so that the ink droplet 30 is ejected. At the same time, the piezoelectric element 110 of nozzle element #3 is set to approximately the same magnitude of polarization but an opposite direction of polarization to the piezoelectric element 110 in nozzle element #4. Accordingly, the volume in the ink pressure chamber 140 increases at $t_2$, so that the ink pressure chamber 140 draws ink from the common ink chamber 150 and does not eject an ink droplet. Since the switching element SW1 is off, the A&B-phase piezoelectric element drive pulse voltages are not applied to the piezoelectric elements 110 in nozzle elements #1 and #2. Therefore, the piezoelectric elements 110 in nozzle elements #1 and #2 remain still and do not expand or contract.

Next, both switching elements SW1 and SW2 are turned off during the period T(2)-A shown in FIG. 4. Hence, nozzle elements #3 and #4 are halted, while nozzle elements #1 and #2 continue to remain halted.

Since switching elements SW1 and SW2 are both on in the period T(2)-B, the B-phase drive pulse voltage is applied to nozzle elements #1-#4. At the time $t_3$, the piezoelectric elements 110 of nozzle elements #2 and #4 expand, as shown in FIG. 3(*c*), causing ink droplets to be ejected from nozzle elements #2 and #4.

The following is a description of the operations for the four nozzle elements #1-#4, but a similar control process can be employed when the number of nozzle elements is increased. Specifically, the nozzle elements are driven by the A-phase drive pulse (or B-phase drive pulse) when wishing to eject ink from odd-numbered nozzle elements, while the B-phase drive pulse (or A-phase drive pulse) is used when wishing to eject ink droplets from even-numbered nozzle elements. It is not possible to eject ink droplets simultaneously from two adjacent nozzle elements (i.e. one odd-numbered and one even-numbered). However, in light of the time difference between the A-phase and B-phase drive pulses, it is possible to eject ink droplets from desired nozzle elements by offsetting recording data for odd-numbered nozzle elements from recording data for even-numbered nozzle elements.

The recording head 10 is suitable for a serial scanning inkjet recording device and a line scanning inkjet recording device. In a serial scanning inkjet recording device, the recording head 10 is disposed so that the surface of the orifice plate 130 confronts the recording paper. The recording head 10 ejects ink droplets based on the recording signal while being moved in a direction that transverses the conveying direction of the recording paper (main scan) to record one line of an image. Subsequently, the recording paper is conveyed a prescribed distance in the conveying direction (sub scan), and the recording head 10 repeats the main scan to record the next line of the image. The entire image is recorded by repeatedly performing the main scan and sub scan.

When employing the recording head 10 in a line scanning inkjet recording device, a plurality of recording heads are arranged in a row along the width of a continuous recording paper so as to oppose the surface of the recording paper across the entire width. The recording heads 10 eject ink droplets based on recording signals, while simultaneously the continuous recording paper is moved at a high speed in the longitudinal direction of the paper (main scan). Dot formation on the scan lines is controlled by controlling the main scan and the ejection of ink droplets to record an image on the recording paper.

As described above, adjacent nozzle elements in the recording head 10 according to the preferred embodiment have piezoelectric elements 110 with approximately the same magnitude of polarization but reverse polarities. Since the piezoelectric elements 110 are driven by drive pulse voltages having similar waveforms, vibrations in the diaphragms, excitation of the piezoelectric element support base, displacement of each element, and the like in the adjacent nozzle elements are in completely opposite directions to one another.

Accordingly, it is possible to suppress the excitation of other elements, that is, excitation of other nozzle elements or such common members as the piezoelectric element support base and the housing. In other words, this structure suppresses abnormal vibrations when driving the piezoelectric element, thereby avoiding abnormal vibrations in the meniscus formed in the nozzle holes. Since cross talk is reduced in this way, ink droplets can be ejected with greater stability. Hence, ink droplets can be reliably ejected from each nozzle with a uniform ejection rate and droplet weight. Therefore, the present invention can provide an inkjet recording device capable of reliably recording high-quality images at a high speed.

Since two adjacent nozzle elements are connected to a single switching element in the recording head 10 according to the preferred embodiment, the number of switching elements and the number of wires in a cable connecting the recording head to the recording head driving device can be half that required for conventional devices, thereby reducing the cost and size of the recording device.

Figure 5:
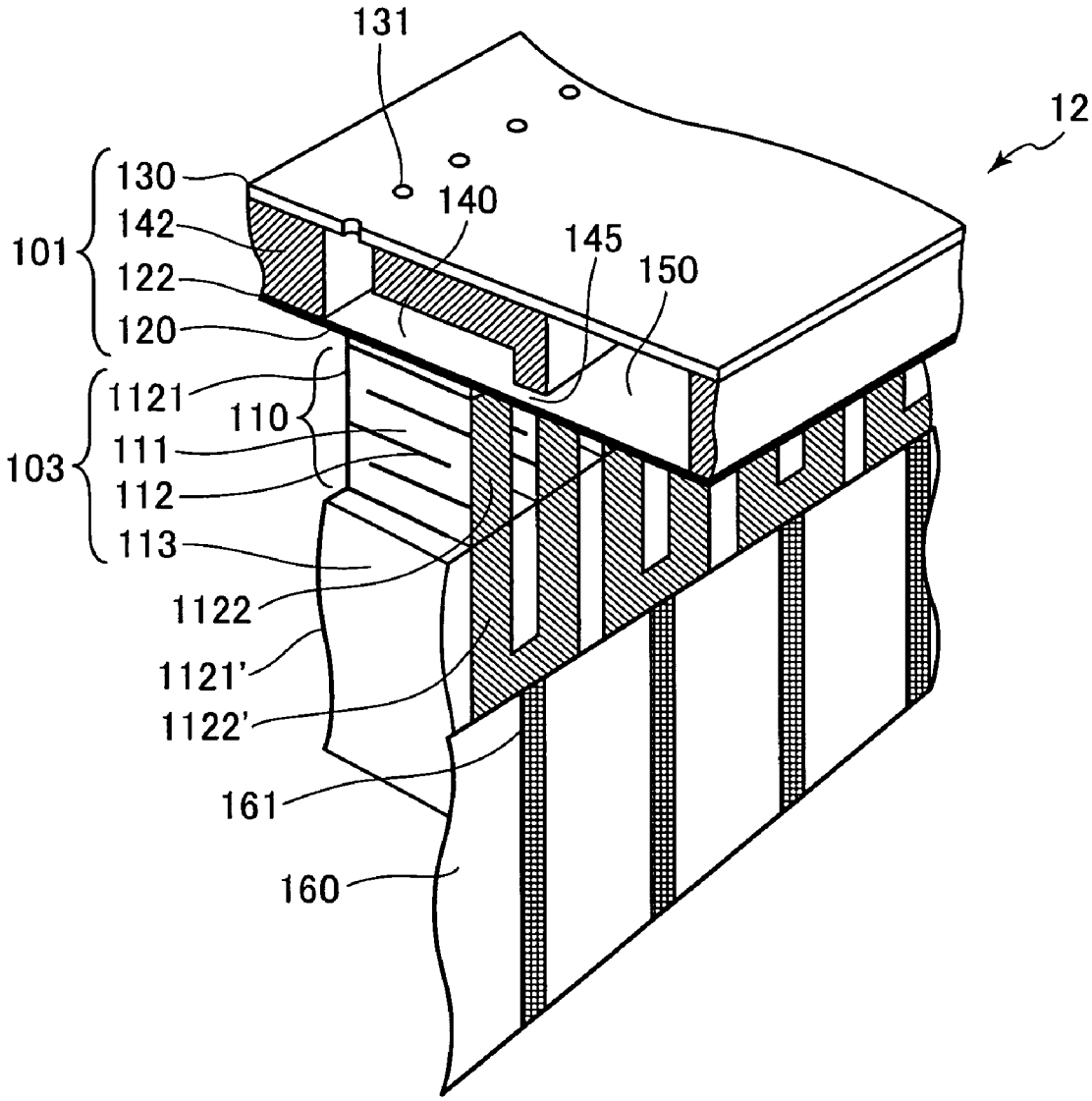
FIG. 5 is a perspective view of a recording head according to a second embodiment of the present invention.

Next, a recording head 12 according to a second embodiment of the present invention will be described with reference to FIG. 5, wherein like parts and components are designated with the same reference numerals to avoid duplicating description. FIG. 5 shows the general structure of the recording head 12 according to the second embodiment. Unlike the recording head 10 in the first embodiment, pairs of the individual electrodes 1122 are connected on the surface of the piezoelectric element support base 113. With this construction, the surface area of the individual electrodes 1122' capable of being connected to the flexible cable terminals 161 is greater than that in the first embodiment, thereby facilitating connection of the individual electrodes 1122' with the flexible cable terminals 161 of the flexible cable 160.

Figure 6:
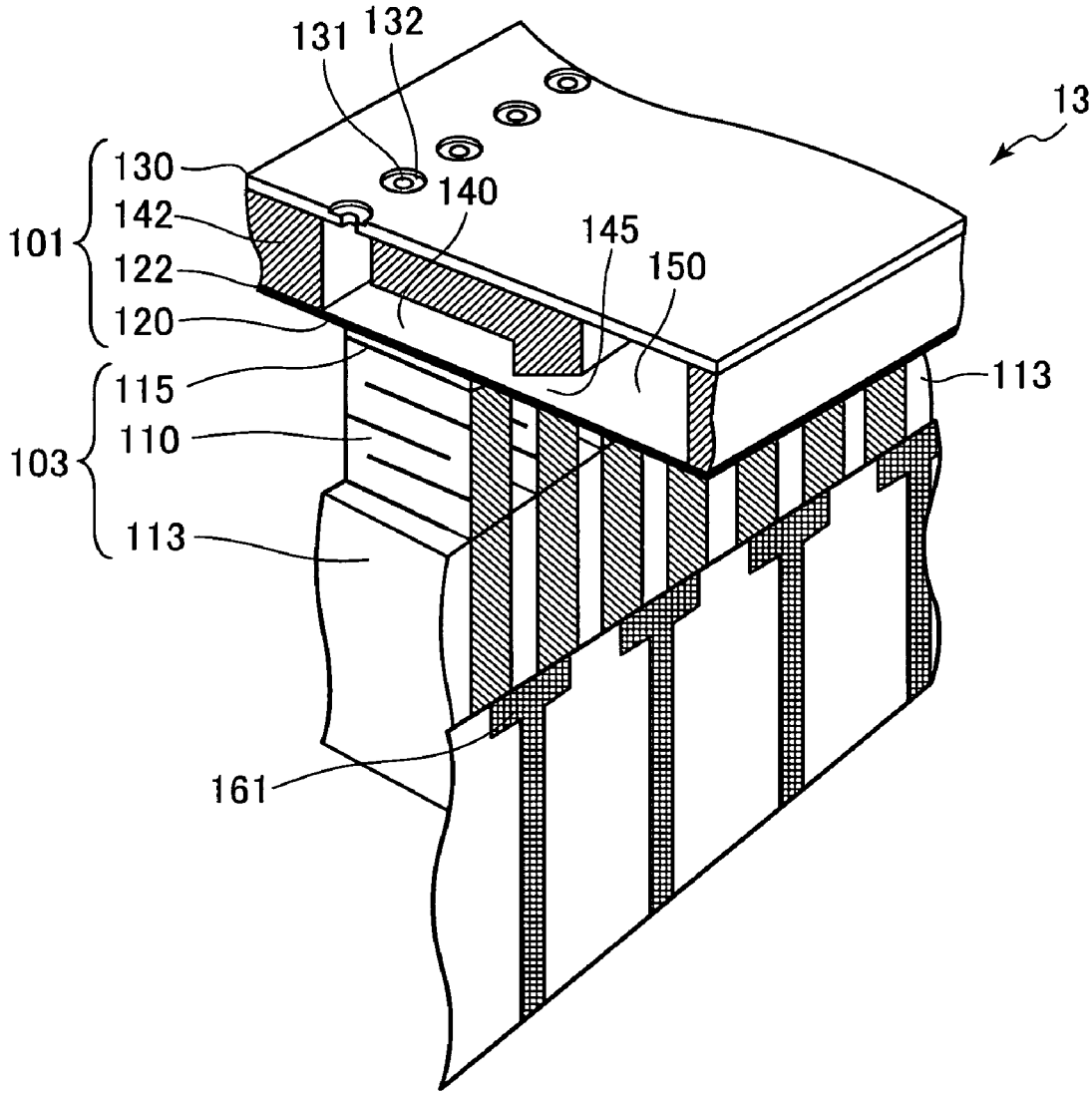
FIG. 6 is a perspective view of a recording head according to a third embodiment of the present invention.

Next, a recording head 13 according to a third embodiment of the present invention will be described with reference to FIG. 6, wherein like parts and components are designated with the same reference numerals to avoid duplicating description. FIG. 6 shows the general structure of the recording head 13 according to the third embodiment. In the third embodiment, the ink channel inlet 145 grows gradually smaller in a direction from the common ink chamber 150 toward the ink pressure chamber 140, giving the ink channel inlet 145 the characteristics of a fluid diode in the direction from the common ink chamber 150 to the ink pressure chamber 140.

Since ink flows in the direction from the common ink chamber 150 to the ink pressure chamber 140, this construction can restrain movement of the meniscus generated in the nozzle hole 131 toward the ink pressure chamber 140. Hence, this construction can prevent air from being sucked through the nozzle hole 131 and can prevent a drop in frequency response in ink ejection.

In the third embodiment, an ink accumulating part 132 is also formed around each nozzle hole 131 as a recessed part. Since ink accumulated in the ink accumulating part 132 around the nozzle hole can flow into the ink pressure chamber 140, this construction more effectively prevents the lo meniscus from being completely drawn into the ink pressure chamber 140 and, hence, prevents air bubbles from being drawn into the ink pressure chamber 140.

Next, a recording head 14 according to a fourth embodiment of the present invention will be described with reference to FIG. 7, wherein like parts and components are designated with the same reference numerals to avoid duplicating description.

Figure 7:
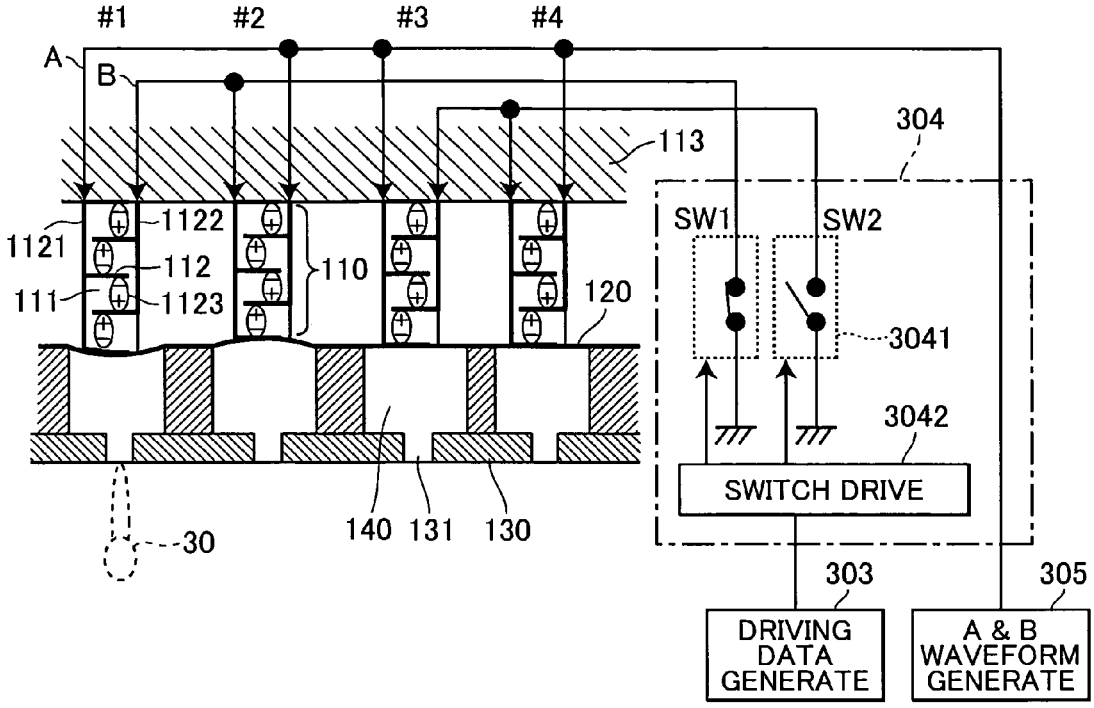
FIG. 7 is a perspective view of a recording head according to a fourth embodiment of the present invention.

FIG. 7 shows the general structure of the recording head 14 according to the fourth embodiment. Unlike the recording head 10 in the first embodiment, the polarizations of all of the piezoelectric elements 110 have same direction, the common electrode 1121 of the nozzle element #1 is connected to the individual electrode 1122 of the nozzle element #2 via a wire A and the individual electrode 1122 of the nozzle element #1 is connected to the common electrode 1121 of the nozzle element #2 via a wire B. The wire A is connected to the A&B phase piezoelectric element driving pulse waveform generating circuit 305 and the wire B is connected to the switching elements 3041 for each pair of nozzle elements.

With this construction, vibrations in the diaphragms, excitation of the piezoelectric element support base, displacement of each element, and the like in the adjacent nozzle elements are in completely opposite directions to one another. Accordingly, it is possible to suppress the excitation of other elements with the piezoelectric elements 110 whose polarizations have same direction.

Figure 8:
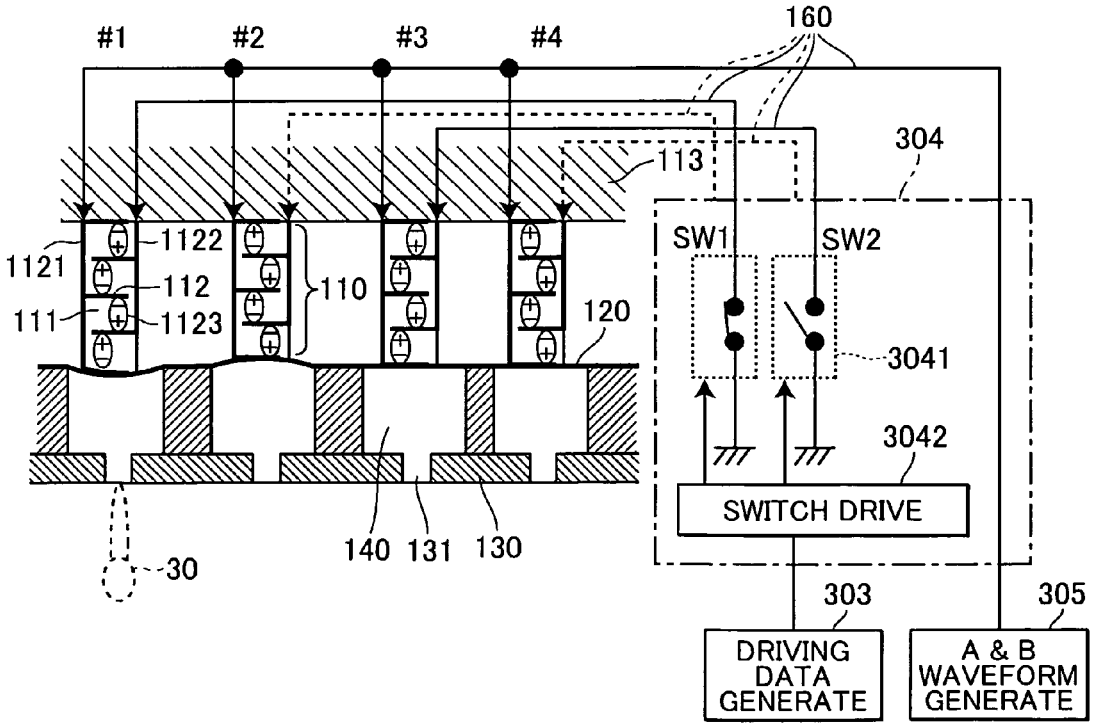
FIG. 8 is an explanatory diagram illustrating a variation of the recording head according to the preferred embodiments.

While the invention has been described in detail with reference to specific embodiments thereof, it would be apparent to those skilled in the art that many modifications and variations may be made therein without departing from the spirit of the invention, the scope of which is defined by the attached claims. For example, a pair of the flexible cables 160 can be connected on the circuit board of the piezoelectric element drive switching circuit 304, as shown in FIG. 8, for sharing a switching element with two adjacent nozzle elements. While the number of wires in the flexible cable 160 is the same as the conventional device in this case, the number of switching elements can be decreased by half.

In addition to an inkjet recording device for recording on a recording paper in ink, the recording head can also be applied to an industrial liquid dispenser, such as a marking device or a coating device for marking or coating products. Further, the piezoelectric elements used in the present invention are not limited to the pole-shaped elements described in the preferred embodiments.

What is claimed is:

1. An ink jet recording head unit comprising:

a plurality of nozzle elements that ejects ink droplets, each nozzle element having an ink pressure chamber filling ink therein, an orifice leading to the ink pressure chamber, and a diaphragm formed as a part of the ink pressure chamber and having a first surface opposed to the ink pressure chamber, and a second surface opposite to the first surface;

a plurality of piezoelectric elements provided in one-to-one correspondence with the plurality of nozzle elements, each piezoelectric element being fixed to the second surface of each diaphragm and having a positive pole and a negative pole, each piezoelectric element expanding and contracting to vary volume of the ink pressure chamber when a voltage potential difference between the positive pole and the negative pole is varied, wherein each nozzle element ejects an ink droplet from the corresponding orifice when the volume of the corresponding ink pressure chamber decreases; and a driving unit that controls expansion and contraction of each piezoelectric element, wherein the plurality of nozzle elements includes a first nozzle element and a second nozzle element adjacent to the first nozzle element, and a first piezoelectric element and a second piezoelectric element correspond to the first nozzle element and the second nozzle element respectively, wherein polarization of the first nozzle element is substantially equivalent to, but directionally opposite of the polarization of the piezoelectric element of the second nozzle element, and wherein the driving unit controls the first piezoelectric element and the second piezoelectric element to expand and contract in a complementary manner.

2. The ink jet recording head unit according to claim 1, wherein the driving unit further comprises a drive signal generating unit that generates drive signals, wherein the drive signal generating unit applies the drive signal to the positive pole of the first piezoelectric and the negative pole of the second piezoelectric element so that the first piezoelectric element and the second piezoelectric element expands and contracts in a complementary manner.

3. The ink jet recording head unit according to claim 2, wherein each piezoelectric element expands when the voltage potential difference increases, and contracts when the voltage potential difference decreases, wherein the drive signal generating unit generates an A-phase drive pulse that begins with a negative pulse followed by a positive pulse, and a B-phase drive pulse that begins with a positive pulse followed by a negative pulse.

4. The ink jet recording head unit according to claim 2, wherein each piezoelectric element has a common electrode to which the drive signal is applied and an individual electrode, wherein the positive pole of the first piezoelectric element is connected to the common electrode of the first piezoelectric element and the negative pole of the first piezoelectric element is connected to the individual electrode of the first piezoelectric element, when the positive pole of the second piezoelectric element is connected to the individual electrode of the second piezoelectric element and the negative pole of the second piezoelectric element is connected to the common electrode of the second piezoelectric element.

5. The ink jet recording head unit according to claim 4, wherein the driving unit further comprises:

a switching element capable of performing on/off switching actions, the switching element having a first terminal to which a predetermined voltage is applied and a second terminal connected to the individual electrodes of both of the first piezoelectric element and the second piezoelectric element commonly so that each piezoelectric element expands and contracts when the switching element is closed; and a switching element driving unit that controls the on/off actions of the switching element.

6. The ink jet recording head unit according to claim 5, further comprising a switching element mounting base mounting the plurality of switching elements, the individual electrodes of the first piezoelectric element and the second piezoelectric element are electrically connected by wiring on the switching element mounting base.

7. The ink jet recording head unit according to claim 1, further comprising a piezoelectric element support base that assists the piezoelectric element to be fixed to the second surface of the diaphragm, wherein the individual electrodes of the first piezoelectric element and the second piezoelectric element are electrically connected by wiring on the piezoelectric element support base.

8. The ink jet recording head unit according to claim 1, further comprising:

an ink chamber that provides the ink pressure chamber with ink, and an ink inlet part connecting the ink chamber to the ink pressure chamber so that the ink flows from the ink chamber into the ink pressure chamber, and having a first opening at which the inlet part is connected to the ink pressure chamber and a second opening at which the inlet part is connected to the ink chamber, wherein an area of the first opening is smaller than an area of the second opening.

9. The ink jet recording head unit according to claim 1, further comprising an orifice plate on which the orifice is formed, the orifice plate including an ink-accumulating part formed around periphery of the orifice, and concaved in the orifice plate.

10. An ink jet recording device comprising:

an ink jet recording head including;

a plurality of nozzle elements that ejects ink droplets, each nozzle element having an ink pressure chamber filling ink therein, an orifice leading to the ink pressure chamber, and a diaphragm formed as a part of the ink pressure chamber and having a first surface opposed to the ink pressure chamber, and a second surface opposite to the first surface; and a plurality of piezoelectric elements provided in one-to-one correspondence with the plurality of nozzle elements, each piezoelectric element being fixed to the second surface of each diaphragm and having a positive pole and a negative pole, each piezoelectric element expanding and contracting to vary volume of the ink pressure chamber when a voltage potential difference between the positive pole and the negative pole is varied, wherein each nozzle element ejects an ink droplet from the corresponding orifice when the volume of the corresponding ink pressure chamber decreases; and a driving unit that controls expansion and contraction of each piezoelectric element, wherein the plurality of nozzle elements includes a first nozzle element and a second nozzle element adjacent to the first nozzle element, and a first piezoelectric element and a second piezoelectric element correspond to the first nozzle element and the second nozzle element respectively, wherein polarization of the first nozzle element is substantially equivalent to, but directionally opposite of the polarization of the piezoelectric element of the second nozzle element, and wherein the driving unit controls the first piezoelectric element and the second piezoelectric element to expand and contract in a complementary manner.

11. The ink jet recording device according to claim 10, wherein the driving unit further comprises a drive signal generating unit that generates drive signals, wherein the drive signal generating unit applies the drive signal to the positive pole of the first piezoelectric and the negative pole of the second piezoelectric element so that the first piezoelectric element and the second piezoelectric element expands and contracts in a complementary manner.

12. The ink jet recording device according to claim 11, wherein each piezoelectric element expands when the voltage potential difference increases, and contracts when the voltage potential difference decreases, wherein the drive signal generating unit generates an A-phase drive pulse that begins with a negative pulse followed by a positive pulse, and a B-phase drive pulse that begins with a positive pulse followed by a negative pulse.

13. The ink jet recording device according to claim 11, wherein each piezoelectric element has a common electrode to which the drive signal is applied and an individual electrode, wherein the positive pole of the first piezoelectric element is connected to the common electrode of the first piezoelectric element and the negative pole of the first piezoelectric element is connected to the individual electrode of the first piezoelectric element, when the positive pole of the second piezoelectric element is connected to the individual electrode of the second piezoelectric element and the negative pole of the second piezoelectric element is connected to the common electrode of the second piezoelectric element.

14. The ink jet recording device according to claim 13, wherein the driving unit further comprises:

a switching element capable of performing on/off switching actions, the switching element having a first terminal to which a predetermined voltage is applied and a second terminal connected to the individual electrodes of both of the first piezoelectric element and the second piezoelectric element commonly so that each piezoelectric element expands and contracts when the switching element is closed; and a switching element driving unit that controls the on/off actions of the switching element.

15. The ink jet recording device according to claim 14, further comprising a switching element mounting base mounting the plurality of switching elements, the individual electrodes of the first piezoelectric element and the second piezoelectric element are electrically connected by wiring on the switching element mounting base.

16. The ink jet recording device according to claim 10, further comprising a piezoelectric element support base that assists the piezoelectric element to be fixed to the second surface of the diaphragm, wherein the individual electrodes of the first piezoelectric element and the second piezoelectric element are electrically connected by wiring on the piezoelectric element support base.

17. The ink jet recording device according to claim 10, further comprising:

an ink chamber that provides the ink pressure chamber with ink, and an ink inlet part connecting the ink chamber to the ink pressure chamber so that the ink flows from the ink chamber into the ink pressure chamber, and having a first opening at which the inlet part is connected to the ink pressure chamber and a second opening at which the inlet part is connected to the ink chamber, wherein an area of the first opening is smaller than an area of the second opening.

18. The ink jet recording device according to claim 10, further comprising an orifice plate on which the orifice is formed, the orifice plate including an ink-accumulating part formed around periphery of the orifice, and concaved in the orifice plate.

19. An ink jet recording device comprising:

an ink jet recording head including;

a plurality of nozzle elements that ejects ink droplets, each nozzle element having an ink pressure chamber filling ink therein, an orifice leading to the ink pressure chamber, and a diaphragm formed as a part of the ink pressure chamber and having a first surface opposed to the ink pressure chamber, and a second surface opposite to the first surface; and a plurality of piezoelectric elements provided in one-to-one correspondence with the plurality of nozzle elements, each piezoelectric element being fixed to the second surface of each diaphragm and having a positive pole, a negative pole, a common electrode to which a drive signal is applied and an individual electrode, each piezoelectric element expanding and contracting to vary volume of the ink pressure chamber when a voltage potential difference between the positive pole and the negative pole is varied, each nozzle element ejecting an ink droplet from the corresponding orifice when the volume of the corresponding ink pressure chamber decreases; and a driving unit that controls expansion and contraction of each piezoelectric element, the driving unit including:

a drive signal generating unit that generates the drive signals;

a switching element capable of performing on/off switching actions, the switching element having a first terminal to which a predetermined voltage is applied and a second terminal connected to the individual electrodes of both of the first piezoelectric element and the second piezoelectric element commonly so that each piezoelectric element expands and contracts when the switching element is closed; and a switching element driving unit that controls the on/off actions of the switching element; and wherein the plurality of nozzle elements includes a first nozzle element and a second nozzle element adjacent to the first nozzle element, and a first piezoelectric element and a second piezoelectric element correspond to the first nozzle element and the second nozzle element respectively, and wherein the positive pole of the first piezoelectric element is connected to the common electrode of the first piezoelectric element and the negative pole of the first piezoelectric element is connected to the individual electrode of the first piezoelectric element, when the positive pole of the second piezoelectric element is connected to the individual electrode of the second piezoelectric element and the negative pole of the second piezoelectric element is connected to the common electrode of the second piezoelectric element.

20. The ink jet recording device according to claim 19, wherein each piezoelectric element expands when the voltage potential difference increases, and contracts when the voltage potential difference decreases, wherein the drive signal generating unit generates an A-phase drive pulse that begins with a negative pulse followed by a positive pulse, and a B-phase drive pulse that begins with a positive pulse followed by a negative pulse.

* * * * *